US005390645A

United States Patent [19]

Cook et al.

[11] Patent Number: 5,390,645

[45] Date of Patent: Feb. 21, 1995

[54] FUEL VAPOR LEAK DETECTION SYSTEM

[75] Inventors: John E. Cook; Paul D. Perry, both of Chatham, Canada

[73] Assignee: Siemens Electric Limited, Chatham, Canada

[21] Appl. No.: 205,983

[22] Filed: Mar. 4, 1994

[51] Int. Cl.[6] ..... F02M 33/02

[52] U.S. Cl. ..... 123/520; 123/198 D

[58] Field of Search ..... 123/516, 518, 519, 520, 123/198 D; 73/118.1, 40

[56] References Cited

U.S. PATENT DOCUMENTS

| | | | |
|---|---|---|---|
| 5,065,350 | 11/1991 | Fedder | 73/40 |
| 5,146,902 | 9/1992 | Cook et al. | 123/520 |
| 5,297,529 | 3/1994 | Cook et al. | 123/520 |

*Primary Examiner*—Willis R. Wolfe
*Assistant Examiner*—Thomas N. Moulis
*Attorney, Agent, or Firm*—George L. Boller; Russel C. Wells

[57] ABSTRACT

Leakage from a portion of a canister purge system which includes a fuel tank and a vapor collection canister is detected by closing off that portion and then positively pressurizing it by means of an air pump. The air that is pumped by the air pump is split into two separate paths, one to pressurize the closed-off portion of the system, and the other to flow through a known orifice. A differential flow meter compares the flow through one path with that through the other to determine if there is leakage.

8 Claims, 2 Drawing Sheets

FUEL VAPOR LEAK DETECTION SYSTEM

FIELD OF THE INVENTION

This invention relates generally to evaporative emission control systems that are used in automotive vehicles to control the emission of volatile fuel vapors. Specifically the invention relates to an on-board diagnostic system for determining if a leak is present in a portion of the system which includes the fuel tank and the canister that collects volatile fuel vapors from the tank's headspace.

REFERENCE TO A RELATED PATENT AND APPLICATIONS

In certain respects this invention is an improvement on the invention of commonly assigned U.S. Pat. No. 5,146,902. There are additional commonly assigned patent applications that relate to this general field and are known to the USPTO by virtue of their pendency.

BACKGROUND AND SUMMARY OF THE INVENTION

A typical evaporative emission control system in a modern automotive vehicle comprises a vapor collection canister that collects volatile fuel vapors generated in the fuel tank. During conditions conducive to purging, the canister is purged to the engine intake manifold by means of a canister purge system that comprises a canister purge solenoid valve that is operated by an engine management computer. The canister purge valve is opened in an amount determined by the computer to allow the intake manifold vacuum to draw vapors from the canister through the valve into the engine.

U.S. governmental regulations require that certain future automobiles that are powered by volatile fuel such as gasoline have their evaporative emission control systems equipped with on-board diagnostic capability for determining if a leak is present in a portion of the system which includes the fuel tank and the canister. One proposed response to that requirement is to connect a normally open solenoid valve in the canister vent, and to energize the solenoid when a diagnostic test is to be conducted. A certain vacuum is drawn in a portion of the system which includes the tank headspace and the canister, and with the canister and the tank headspace not being vented due to the closing of the canister vent, a certain loss of vacuum over a certain time will be deemed due to a leak. Loss of vacuum is detected by a transducer mounted on the fuel tank. Because of the nature of the construction of typical fuel tanks, a limit is imposed on the magnitude of vacuum that can be drawn. Too large a vacuum will result in deformation and render the measurement meaningless. In order to avoid this problem, a relatively costly vacuum transducer is required. Since typical automotive vehicles are powered by internal combustion engines which draw intake manifold vacuum, such vacuum may be used for performance of the diagnostic test, but typically this requires that the engine be running in order to perform the test.

The invention disclosed in commonly assigned U.S. Pat. No. 5,191,870 provides a solution to the leak detection problem which is significantly less costly. The key to that solution is a new and unique vacuum regulator/-sensor which is disposed in the conduit between the canister purge solenoid and the canister. The vacuum regulator/sensor is like a vacuum regulator but with the inclusion of a switch that is used to provide a signal indicating the presence or the absence of a leak. A diagnostic test is performed by closing the tank vent and using the engine manifold vacuum to draw, via the canister purge solenoid valve and the vacuum regulator/sensor, a specified vacuum in the tank headspace and canister. Upon the requisite vacuum having been drawn, the vacuum regulator/sensor closes to trap the drawn vacuum. If unacceptable leakage is present, a certain amount of vacuum will be lost within a certain amount of time, and that occurrence causes the switch of the vacuum regulator/sensor to give a signal indicating that condition.

U.S. Pat. No. 5,146,902 discloses a diagnostic system and method for evaluating the integrity of a portion of the canister purge system that includes the tank and canister by means of positive pressurization rather than negative pressurization (i.e., rather than by drawing vacuum). In certain canister purge systems, such a diagnostic system and method may afford certain advantages over the system and method described in U.S. Pat. No. 5,191,870. For example, certain types of leaks, for example cracked hoses and faulty gas caps, may be more susceptible to successful detection. Moreover, the evaporative emission control system may be diagnosed either with or without the automobile's engine running.

A further benefit of positive pressurization over negative pressurization is that the increased pressure suppresses the rate of fuel vapor generation in the tank, and such attenuation of fuel vapor generation during a diagnostic test reduces the likelihood that the test will give, under hot weather conditions which promote fuel vapor generation, a false signal that would erroneously confirm the integrity of the canister and tank whereas the same test during cold weather would indicate a leak.

Certain of the commonly assigned pending applications relate to introducing the pumped air into the evaporative emission system through an atmospheric vent port of the canister after that port has been closed to atmosphere by the closing of a canister vent solenoid (CVS) valve through which the canister is otherwise vented to atmosphere during non-test times. Such pumping may afford certain advantages over pumping air directly into the tank headspace.

In all of the aforementioned systems, certain variable ambient conditions are either more or less of an influence on the test accuracy. Atmospheric pressure and temperature are two such influences, and where they are significant enough, means must be provided to compensate for their variations.

The present invention relates to a new and improved system that is in certain important respects simpler, and hence more cost-effective. For example, the present invention enables a relatively expensive pressure transducer and a canister vent valve to be eliminated from the system.

Briefly, and without necessarily limiting its scope, the present invention comprises the use of a centrifugal air pump (i.e. a blower) to blow ambient air through a differential flow meter which splits the pump flow into two paths, a first flow path through a first flow sensor leading to the closed vapor headspace in the tank-canister, and a second comprising a second flow sensor in series with a calibrated orifice leading to atmosphere. The two flow sensors provide respective electric signals representative of the respective air flows through them to respective inputs of an electronic comparator circuit. The latter takes the difference and provides an electrical output signal that is indicative of that difference. The capacity of the air pump and the calibrated orifice are sized in relation to a certain range of leakage from the tank-canister headspace such that a reasonably accurate measurement of the amount of leakage can be obtained, if the leakage is in fact within that range. For gross leakage, the accuracy of the measurement may be somewhat problematic, but that will typically be unimportant since a gross leakage will in any event be indicated.

Further specific details of the construction and arrangement of the inventive system, and of the method of operation thereof, along with additional features and benefits, will be presented in the ensuing description.

A drawing accompanies this disclosure and portrays a presently preferred embodiment of the invention according to the best mode presently contemplated for carrying out the invention.

DESCRIPTION OF THE PREFERRED EMBODIMENT

Figure 1:
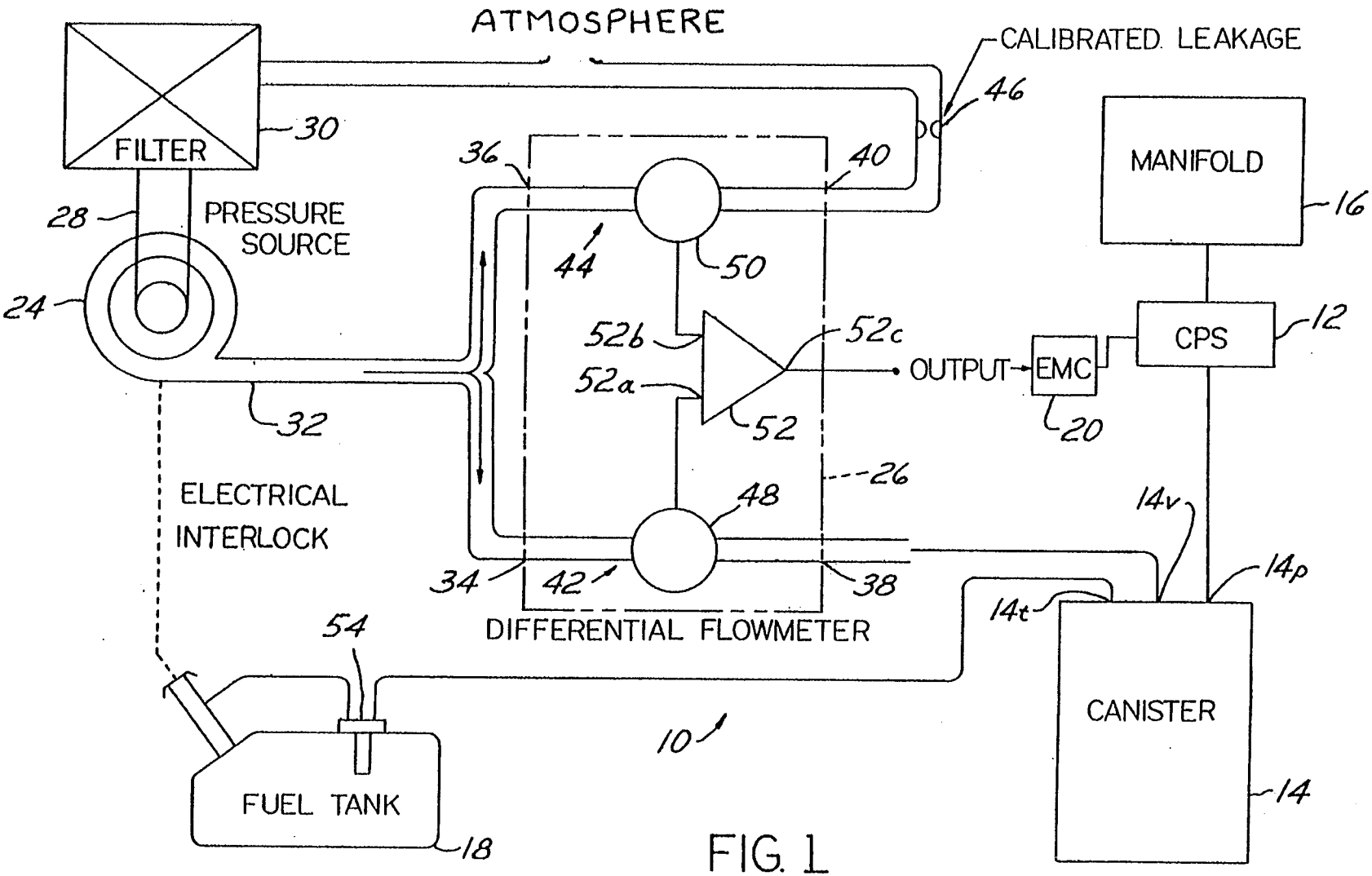
FIG. 1 is a schematic diagram of a representative canister purge system, including a diagnostic system embodying principles of the present invention.

FIG. 1 shows a representative canister purge system 10 embodying principles of the invention. System 10 comprises a canister purge solenoid (CPS) valve 12 and a charcoal canister 14 associated with the intake manifold 16 of an automotive vehicle internal combustion engine and with a fuel tank 18 of the automotive vehicle which holds a supply of volatile liquid fuel for powering the engine. Canister 14 comprises a tank port **14*t*, an atmospheric vent port 14*v*, and a purge port 14*p*. CPS valve 12 is under the control of an engine management computer 20** for the engine.

For use in conducting the on-board diagnostic testing that confirms integrity of the canister purge system against leakage, an electric operated centrifugal pump (blower) 24, and a differential flow meter (DFM) 26 are provided. Pump 24 has an air inlet 28 that is communicated to ambient atmospheric air, typically through a filter 30 as shown, and an air outlet 32 that is communicated to first and second inlet ports 34, 36 of DFM 26. DFM 26 also comprises first and second outlet ports 38, 40, a first flow path 42 between inlet port 34 and outlet port 38 and a second flow path 44 between inlet port 36 and outlet port 40. These two flow paths are separate from each other, with flow path 42 leading to atmospheric vent port 14v and with flow path 44 leading to atmosphere through a calibrated orifice 46. Flow path 42 comprises a first flow meter 48 for measuring flow through the path while flow path 44 comprises a second flow meter 50 for measuring the flow through it.

DFM 26 further comprises a comparator circuit 52 that may be of any conventional electronic circuit construction having a first input **52*a*, a second input 52*b*, and an output 52*c*. Flow meter 48 delivers to input 52*a* an electric signal that is representative of the air flow passing through it. Similarly, flow meter 50 delivers to input 52*b* an electric signal that is representative of the air flow passing through it. The comparator delivers an output signal at output 52*c* that is representative of the difference between the two input signals. There are circuit connections whereby operation of pump 24 is controlled by computer 20 and the signal output from 52*c*** is delivered to the computer.

The tank headspace is placed in communication with canister port **14*t* through a path that includes a conventional roll-over valve 54** mounted in the top wall of the tank.

The canister purge system operates in conventional manner, and may be briefly described as follows. Under conditions conducive to purging, computer 20 causes the normally closed CPS valve 12 to open in a controlled manner. The canister-tank headspace is vented to atmosphere through pump 24 because of the nature of the pump which provides low restriction free flow in either direction through it when it is not running, such as for example a centrifugal pump. (This free flow capability allows the canister vent solenoid that was used in a prior system to be eliminated. Note, that because the pump outlet is communicated to the atmospheric vent port **14*v* vapor fumes will not escape through it.) The result of opening CPS valve 12 is that a certain amount of the engine manifold vacuum is delivered to canister 14 via purge port 14*p* causing collected vapors to flow from the canister through CPS valve 12** to the engine manifold where they entrain with the induction flow entering the engine's combustion chamber space to be ultimately combusted.

The system functions in the following manner to perform a diagnostic test of the integrity against unacceptable leakage of that portion of the CPS system upstream of CPS valve 12 in the direction of the purge flow to the engine including leakage through CPS valve 12 to the engine. The test proceeds by computer 20 commanding CPS valve 12 to first close and then pump 24 to operate and thus increasingly positively pressurize the tank/canister through the first flow path 42 through DFM 26. Assuming that any leakage that may be present in the tank-canister-system is less than a gross leak, pressure will eventually build to some point after a certain amount of time. After the elapse of an amount of time that has been pre-calculated based on the size of the system and a range where accurate leakage measurement can be obtained, the measurement is taken by the computer reading the output of comparator 52. If a gross leak exists, the flow through the second flow path 44 will be small in comparison to that through the first flow path 42 since the flow will take the path of least resistance, and the signal output from **52*c*** will simply indicate a gross leak, rather than necessarily providing an accurate measurement of the size of the leak as it will do within the measurement range for which the system is designed.

Figure 2:
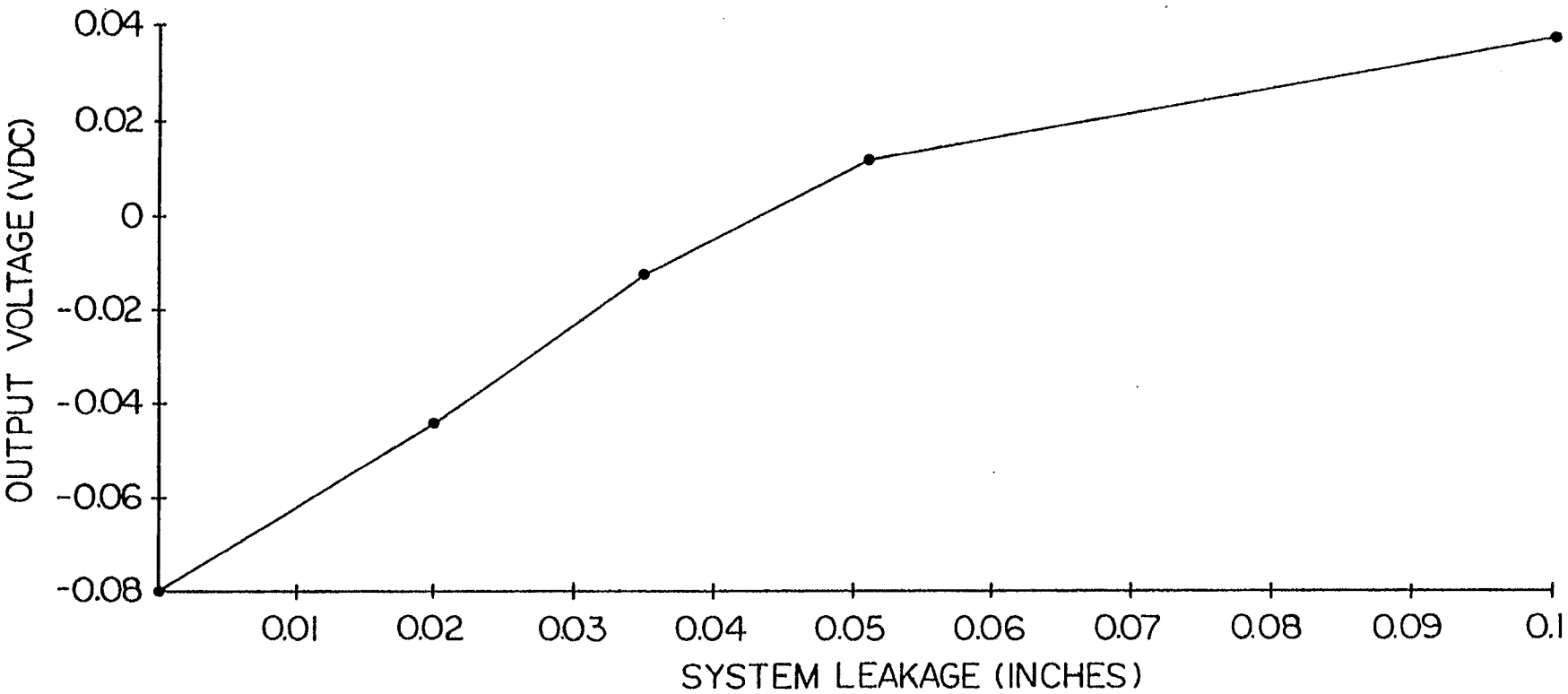
FIG. 2 is a graph useful in appreciating certain aspects of the invention.

The disclosed embodiment possesses the capability for measuring, with reasonable accuracy over a range of test conditions, the effective orifice size of a leak. FIG. 2 presents a series of graph plots depicting the output voltage of comparator 52 as a function of effective orifice size (diameter) of a leak.

The inventive system has important advantages including: being unaffected by ambient temperature and atmospheric pressure; being unaffected by engine intake manifold vacuum; being unaffected by variations in supply voltage in the electrical system; being able to run the test under the most favorable condition, where the vehicle is at rest and the engine is off, provided that operation of pump 24 does not depend on the engine running, e.g., an electrically driven pump. These advantages are due largely to the differential nature of the measurement process. While the invention has a measurement capability as indicated by FIG. 2, it can be used simply to provide a binary indication, i.e., acceptable or unacceptable.

Although the disclosed embodiment comprises the two flow meters that deliver respective electrical flow signals to comparator 52, principles of the invention also contemplate differential sensing by means of a mechanical flow comparator that delivers an electric signal for providing a binary indication for distinguishing between an acceptable and an unacceptable system. FIG. 1 shows an electrical interlock between the gas tank filler cap and the pump that would be effective to shut off the pump if the cap were removed during a test, and in some instances this interlock may be a feature that is desired to be incorporated into a system.

Having disclosed generic principles of the invention, this application is intended to provide legal protection for all embodiments falling within the scope of the following claims.

What is claimed is:

1. A canister purge system comprising a collection canister for collecting volatile fuel vapors from a fuel tank, and means for selectively purging collected fuel vapors from said canister to an internal combustion engine's intake manifold for entrainment with a combustible mixture that passes from the intake manifold into combustion chamber space of the engine for combustion therein, said means including a purge flow path between a purge port means of said canister and the intake manifold, said canister further having tank port means for communicating said canister with said fuel tank, characterized by an associated diagnostic system for detecting leakage from a portion of the canister purge system, including said canister and tank, when said portion is closed to conduct a leakage test, said diagnostic system comprising pump means for positively pressurizing said portion by conducting a first portion of the pump means flow through a first flow path from said pump means to said portion of the canister purge system and concurrently conducting a second portion of the pump means flow from said pump means through a second flow path containing a known orifice means, means for detecting the flow differential between that first portion of the pump means flow passing through said first flow path and that second portion of the pump means flow passing through said second flow path, and means for determining the leakage from the detected flow differential.

2. A canister purge system as set forth in claim 1 in which said first flow path and said second flow path comprise respective flow meters, and each flow meter provides a respective signal to a comparator means that detects the flow differential.

3. A canister purge system as set forth in claim 2 in which said signals are electrical in nature and said comparator means comprises an electrical comparator circuit.

4. A canister purge system as set forth in claim 2 in which said known orifice means is disposed downstream of the flow meter in the second flow path.

5. A canister purge system as set forth in claim 2 in which said known orifice means is disposed in said second flow path between the flow meter in said second flow path and atmosphere.

6. A canister purge system as set forth in claim 1 in which said pump means comprises a single pump, said first flow path extends from said single pump to a vent port of said canister, and said single pump provides for said vent port to be vented to atmosphere when the single pump is not running.

7. A canister purge system comprising a collection canister for collecting volatile fuel vapors from a fuel tank, and means for selectively purging collected fuel vapors from said canister to an internal combustion engine's intake manifold for entrainment with a combustible mixture that passes from the intake manifold into combustion chamber space of the engine for combustion therein, said means including a purge flow path between a purge port means of said canister and the intake manifold, said canister further having tank port means for communicating said canister with said fuel tank, characterized by an associated diagnostic system for detecting leakage from a portion of the canister purge system, including said canister and tank, when said portion is closed to conduct a leakage test, said diagnostic system comprising pump means having an outlet from which said pump means pumps a gas flow, passage means that conducts the gas flow from said pump means outlet and comprises, a first branch through which one portion of the gas flow is conducted to said portion of the canister purge system for positively pressurizing said portion of the canister purge system and a second branch comprising a known orifice means through which another portion of the gas flow is concurrently conducted, respective first and second flow meters disposed at respective locations of said passage means for measuring the respective gas flow portions at said respective locations, and means for processing respective measurements from said first and second flow meters to detect leakage from said portion of the canister purge system.

8. A canister purge system as set forth in claim 7 characterized further in that said pump means has an inlet that is communicated to atmosphere so that the gas flow pumped from said outlet of said pump means is air, and said second branch exhausts the flow of air through it to atmosphere.

* * * * *